US006960061B2

(12) United States Patent
Wagner

(10) Patent No.: US 6,960,061 B2
(45) Date of Patent: Nov. 1, 2005

(54) ROTARY PUMP WITH VENTED PUMP CHAMBER

(75) Inventor: Peter Wagner, Werdohl (DE)

(73) Assignee: K.H. Brinkmann GmbH & Co. KG, Werdohl (DE)

( * ) Notice: Subject to any disclaimer, the term of this patent is extended or adjusted under 35 U.S.C. 154(b) by 71 days.

(21) Appl. No.: 10/783,307

(22) Filed: Feb. 20, 2004

(65) Prior Publication Data

US 2004/0175265 A1 Sep. 9, 2004

(30) Foreign Application Priority Data

Mar. 5, 2003 (DE) ..... 103 09 438

(51) Int. Cl.[7] ..... F04D 9/00

(52) U.S. Cl. ..... 415/169.1; 415/199.6; 415/206; 416/175; 416/198 R; 416/203

(58) Field of Search ..... 415/72, 199.4, 415/199.6, 205, 206, 144, 169.1; 416/175, 416/198 R, 203

(56) References Cited

U.S. PATENT DOCUMENTS 2,704,516 A * 3/1955 Mock et al. ..... 415/56.5

FOREIGN PATENT DOCUMENTS

| | | |
|---|---|---|
| DE | 94 06 463.6 | 7/1994 |
| DE | 43 25 549 | 4/1997 |

* cited by examiner

*Primary Examiner*—Ninh H. Nguyen
(74) *Attorney, Agent, or Firm*—Richard M. Goldberg

(57) ABSTRACT

A rotary pump includes a pump chamber disposed above a liquid basin, and a radial impeller with a vertical axis disposed in the pump chamber. An intake connecting piece is disposed coaxially with the impeller and is positioned in the liquid basin. Either an inner part of the radial impeller or an axial impeller in the intake connecting piece, is provided for aspirating liquid in an interior region of the pump chamber. Venting channels lead from the interior region of the pump chamber to an outside and extend along a side wall of the intake connecting piece up to about a plane of the intake opening of the intake connecting piece. At least one venting channel has a lateral opening in the side wall of the intake connecting piece which opens essentially in a radial direction to the pump chamber.

13 Claims, 1 Drawing Sheet

ROTARY PUMP WITH VENTED PUMP CHAMBER

BACKGROUND OF THE INVENTION

The invention relates to a rotary pump

In particular, the invention is concerned with a rotary pump, which is installed at the machine bed of a machine tool and is used to pump out cooling liquid for the machine tool, which has collected in the liquid basin in the machine bed, so that it can be supplied once again to the tool, optionally with the help of a further pump. Rotary pumps, having a radial construction with open impeller vanes have proven to be particularly suitable for this application, since they are relatively insusceptible to particles, such as chips and the like, which are suspended in the cooling liquid. The rotary pump is disposed in the liquid basin with a vertically oriented axis of rotation of the impeller and a downward pointing intake opening, which is approximately at the level of the liquid. Usually, the pump is designed so that its pumping output is somewhat greater than the inflow of cooling liquid into the liquid basin. When the level of the liquid reaches that of the intake opening, the pump therefore works in a slurping operation, so that a certain amount of air is also aspirated and the liquid pumping output decreases. In this way, the liquid level is control automatically to the level of the intake opening.

In recent years, emulsions, which contaminate the environment relatively little because of their special composition, have been used increasingly as cooling liquid for machine tools. Oil is also used to an increasing extent as cooling liquid for high-performance machine tools. Modem emulsions and the oil, used as cooling liquid, are not degassed as readily as the cooling liquids used in the past. The cooling liquid, which is pumped from the machine bed to the tool or to the workpiece and subsequently collected and returned once again in a closed cycle to the liquid basin in the machine bed, frequently comes into contact with air during this recycling and is mixed with air, especially in the slurping operation of the pump and the concentration of air in the liquid in the form of a dispersion of finely divided air bubbles, increases. In the rotary pump, the aspirated mixture of cooling liquid and air is separated by centrifugal forces. The heavier liquid is forced radially to the outside and an air cushion is formed in the inner region of the pump chamber in the vicinity of the axle of the impeller, becomes larger as the operating time increases and, when it has reached at appropriate size, interferes with the inflow of cooling liquid through the intake opening.

From the DE 43 25 549, a rotary pump of the introductory portion of claim 1 is known, for which at least one venting channel extends approximately from the position of the inner ends of the vanes of a radial impeller along the wall of the intake connecting piece up to the level of the intake opening of the intake connecting piece. The venting channels lead from the inner region of the pump chamber to the open lower end of the intake connecting piece. For this pump, the liquid or the mixture of liquid and air is pumped axially into the inner region of the pump chamber by an axial impeller in the intake connecting piece, as soon as the liquid level is above the intake opening at the lower inlet end of the intake connecting piece. Because the axis of rotation of the impeller is vertical and the intake connecting piece dips in to the liquid basin, this pump makes possible a space-saving construction with a vertical arrangement of the motor above the pump and a reliable decrease in the air cushion in the pump chamber is ensured without an additional exhaust fan.

SUMMARY OF THE INVENTION

Surprisingly, it has turned out that the pump can be operated significantly more quietly, if the venting channels, instead of extending vertically into the pump chamber and ending there in the face wall of the pump chamber below the vanes of the radial impeller, terminate radially in a sidewall at the transition from the intake connecting piece to the pump chamber.

Accordingly, for the inventive rotary pump, the at least one venting channel discharges with a lateral opening in the sidewall of the intake connecting piece essentially radially in the direction of the pump chamber.

Preferred embodiments arise out of the dependent claims

In a preferred embodiment, the venting channels extend essentially vertically and discharge at their upper end laterally in the pump chamber at a level somewhat above the vanes of the axial impeller. This can be accomplished, for example, owing to the fact that the venting channels are constructed from below as blind boreholes in the wall of the intake connecting piece and incised at their inner end by a cylindrical milling out of the intake connecting piece in a manner concentric with the pump axis. In this way, the venting channels form openings in the sidewall of the milled-out region in the vicinity of the interior of the pump chamber.

Alternatively, the venting channels can also extend at an angle, especially in the form of an inverted L. An angled venting channel may, for example, be constructed in such a manner that a borehole, extending from below in the sidewall of the intake connecting piece, intersects a second borehole, which is drilled from the interior of the pump chamber approximately horizontally, for example, radially into a sidewall.

BRIEF DESCRIPTION OF THE DRAWINGS

In the following, a preferred example of the invention is described in greater detail by means of the drawing, in which.

DETAILED DESCRIPTION

Figure 1:
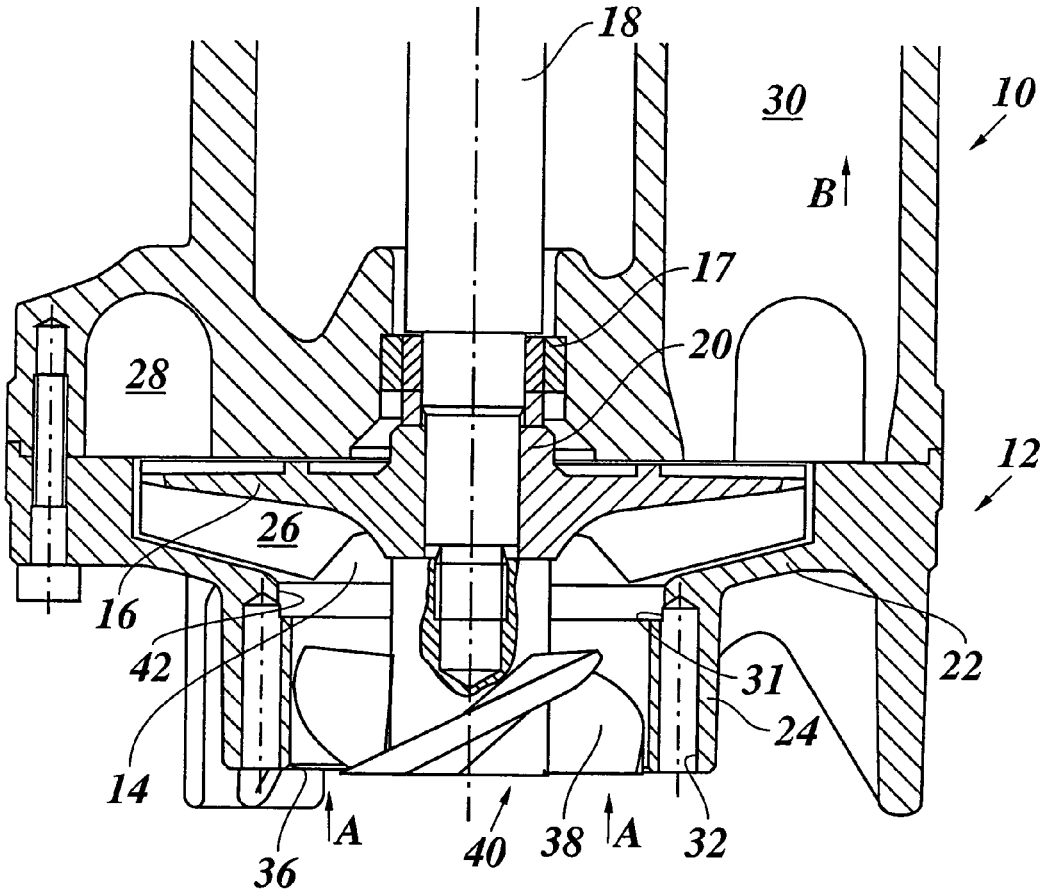
FIG. 1 shows a first axial section through an inventive rotary pump.

The rotary pump, shown in FIG. 1, has an essentially cylindrical housing 10, the lower end of which is provided with a head piece 12, which is attached by a flange and dips with this head piece into a (not shown) liquid basin in the machine bed of a machine tool. A pump chamber 14, which accommodates a radial impeller 16, is formed in the headpiece 12. A shaft 18, the upper end of which is connected with a driving motor, which is not shown, and on the lower end of which the hub 20 of the impeller 16 is keyed, is mounted in the housing 10 coaxially with a bearing 17. At one wall 22 of the headpiece 12, which closes off the pump chamber 14 at the bottom, an intake connecting piece 24, which protrudes downward, is formed coaxially with the impeller 16 and the shaft 18.

The impeller 16 is equipped in the usual manner with vanes 26, which are open in the downward direction and are pitched in such a manner, that the liquid, present in the liquid basin, is aspirated through the intake connection piece 24

(arrow A) and pumped radially to the outside into an annular space 28 above the outer periphery of the pump chamber 14. Because of the liquid pressure, so produced in the annular chamber 28, the liquid flows upward, in the direction of arrow B into a standpipe 30, which is formed in the housing 10 to a pump outlet, which is not shown.

If the aspirated liquid contains finely divided gas or air bubbles, the rotary pump acts like a centrifuge, which separates the gas or the air from the liquid. The air, which has a lower density, accordingly collects in an inner region of the pump chamber, located in the vicinity of the axis of the impeller 16, immediately above the intake connecting piece 24. At the inner sidewall of the intake connecting piece 24, several venting channels 32, distributed in the peripheral direction in the wall of the intake connecting piece 24, are connected at openings 31 with the pump chamber 14. The venting channels 32 terminate at the lower end of the intake connecting piece 24 at the level of an intake opening 36. In this way, the venting channels 32 connect the interior of the pump chamber 14 with the liquid basin. When the level of the liquid in the basin is above the level of the intake opening 36, the lower ends of the venting channels 32 also dip into the liquid. By these means, the aspiration of air over the venting channels 32 by the impeller 16 is prevented.

The radial position of the openings 31 of the venting channels 32 corresponds approximately to the position of the lower ends of the vanes 26. The suction, produced by the impeller 16, is less in the region of the openings 31 of the venting channels 32 than in the region of the intake connecting piece 24. Moreover, an axial impeller 40, which is shown only partly, in section, in FIG. 1 and is equipped with helical vanes 38, is disposed in the intake connecting piece 24 at a continuation of the shaft 18, which is shown only partly. The axial impeller 40 pumps the liquid from the lower end of the intake connecting piece 24 axially upward into the inner region of the pump chamber 14. In this way, the pressure in the interior region of the pump chamber 14 is increased additionally and, accordingly, a pressure drop is produced between the upper and lower ends of the venting channels 32, so that an air cushion, possibly present in the pump chamber, can be decreased through the openings 31 by way of the channels 32. The air, emerging from the lower end of the venting channels 32, bubbles into the liquid in the basin. However, it can also freely escape upward radially outside of the intake connecting piece 24. Only a small portion of the air is therefore aspirated once again over the intake opening 36.

In this way, an effective decrease in the air cushion in the interior of the pump chamber 14 is achieved and, with that, it is ensured that the output of the pump is maintained even if the liquid contains much gas.

Because the upper openings 31 of the venting channel 32 are disposed in the essentially vertically extending side wall of the intake connecting piece 24, the operation of the rotary pump is distinctly quieter than would be the case if the upper ends of the venting channel 32 were to be disposed in the wall 22 directly below the vanes 26 of the radial impeller 16. In the example shown, the venting channels 32 are constructed as blind boreholes, which are cut from a region 42, milled out cylindrically and coaxially with the intake connecting piece 24, at the transition from the pump chamber 14 to the intake connecting piece 24, as a result of which the openings 31 are formed in the cut regions.

Figure 2:
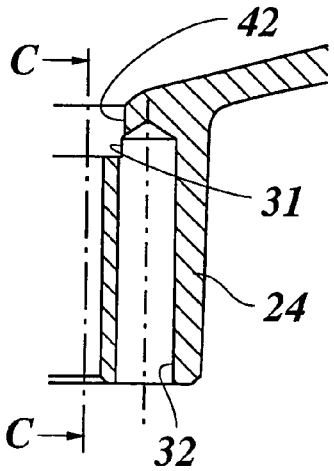
FIG. 2 shows an enlarged section of FIG. 1 with a part of the sidewall of the pump chamber and intake connection piece with a venting channel and FIG. 3 shows a front view of the part of the sidewall with a venting channel of FIG. 2.

FIG. 2 shows a cross section of a part of the side wall of the intake connecting piece 24 with a venting channel 32, disposed therein as in FIG. 1, on a larger scale.

Figure 3:
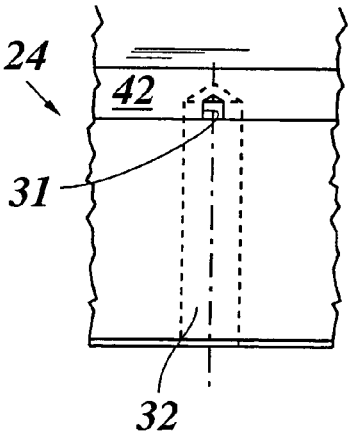

FIG. 3 is a front view of the same section, seen in the direction of the arrows C in FIG. 2. The opening 31, through which the air flows into the venting cannel 32, is disposed in the milled-out region 42 at the upper end of the inside of the side wall of the intake connecting piece 24. The height and width of the opening 31 can be varied by varying the extent of the milled-out region 42. In the example shown the width of the opening 31 is only one third of the diameter of the circular venting channel 32.

In the example shown, the openings 31 of the otherwise straight venting channels 32 are created owing to the fact that the region 42 is milled-out concentrically with the axis of the rotary pump. However, the venting channels can also be constructed at an angle, in that, for example, an essentially vertical borehole in the wall of the intake connecting piece 24, prepared from below, meets a second borehole, which is prepared at the opening 31, essentially at right angles to the first borehole, so that an inverted L-shaped course of the venting channel results.

The number, shape and size of the venting channels 32, as well of the openings 31 can vary from case to case and be optimized with respect to the structural design of the respective pump.

In the example shown, the axial impeller 40 is fastened below the radial impeller 16 on the shaft 18. However, there may also be a separate driving mechanism for the impeller 40. On the other hand, the axial impeller 40 can also be constructed in one piece with the radial impeller 16.

In the examples described, the venting channels 32 extend in the wall of the intake connecting piece 24 or in axial thickenings of this wall. Alternatively, the venting channels 32 may also be constructed at least partly in tubular projections, which are separated from the wall of the connecting piece 24.

It is also not absolutely essential that the lower openings of the venting channels 32 lie precisely in the plane of the intake opening 36. Alternatively, the lower ends of the venting channels 32 can also be set back somewhat from the lower end of the intake connecting piece 24 or also protrude further downward far beyond the latter. In every case, the aspiration of air through the venting channels 32 is prevented as soon as the level in the liquid basin has reached a state, in which the lower ends of the venting channels 32 are immersed in the liquid.

Alternatively, the annular chamber 28, disposed in the example shown above the radial ends of the vanes 26 of the impeller 16, can also be disposed around the periphery of the impeller 16.

In the example shown, a single-stage rotary pump with only one radial impeller 16 is provided. On the other hand, the invention can also be used for multi-stage rotary pumps. In this case, admittedly, an air cushion may also be formed in the downstream stages of the pump. However, if the air cushion in the first stage is eliminated in the manner described above, the pumping output of the first stage is sufficient for displacing the air from the downstream stages.

What is claimed is:

1. A rotary pump comprising:

a pump chamber adapted to be disposed above a liquid basin, a radial impeller with a vertical axis disposed in the pump chamber, an intake connecting piece disposed coaxially with the impeller and adapted to be positioned in the liquid basin, the intake connecting piece including an intake opening, one of:

an inner part of the radial impeller which includes vanes and protrudes axially, and an axial impeller in the intake connecting piece for aspirating liquid in an interior region of the pump chamber, and at least one venting channel which leads from the interior region of the pump chamber to an outside and extends along a side wall of the intake connecting piece up to about a plane of the intake opening of the intake connecting piece, at least one said venting channel having a lateral opening in the side wall of the intake connecting piece which opens essentially in a radial direction to the pump chamber.

2. The rotary pump of claim 1, wherein the at least one venting channel includes an upper end which extends essentially perpendicularly to the at least one venting channel and opens laterally.

3. The rotary pump of claim 2, wherein the at least one venting channel is incised at its upper end by a milling-out procedure, concentric with the intake connecting piece and forming the lateral openings.

4. The rotary pump of claim 3, wherein the axial impeller is formed in one piece with the radial impeller.

5. The rotary pump of claim 3, wherein the at least one venting channel is formed in the side wall of the intake connecting piece.

6. The rotary pump of claim 2, wherein the axial impeller is formed in one piece with the radial impeller.

7. The rotary pump of claim 2, wherein the at least one venting channel is formed in the side wall of the intake connecting piece.

8. The rotary pump of claim 1, wherein the at least one venting channel extends at an angle, in the form of an inverted L.

9. The rotary pump of claim 8, wherein the axial impeller is formed in one piece with the radial impeller.

10. The rotary pump of claim 8, wherein the at least one venting channel is formed in the side wall of the intake connecting piece.

11. The rotary pump of claim 1, wherein the axial impeller is formed in one piece with the radial impeller.

12. The rotary pump of claim 11, wherein the at least one venting channel is formed in the side wall of the intake connecting piece.

13. The rotary pump of claim 1, wherein the at least one venting channel is formed in the side wall of the intake connecting piece.

* * * * *